US005518240A

United States Patent [19]

Igarashi

[11] Patent Number: 5,518,240

[45] Date of Patent: May 21, 1996

[54] GOLF WOOD CLUB HEAD FABRICATING FROM CAST HEAD SECTIONS

[76] Inventor: Lawrence Y. Igarashi, 30231 Tomas Rd., Rancho Santa Margarita, Calif. 92688

[21] Appl. No.: 255,263

[22] Filed: Jun. 7, 1994

[51] Int. Cl.[6] ..... A63B 53/04

[52] U.S. Cl. ..... 473/345

[58] Field of Search ..... 273/167 R, 167 H, 273/173, 167 A, 78, 167 J, 169, 167 F, 80.2

[56] References Cited

U.S. PATENT DOCUMENTS

| | | | |
|---|---|---|---|
| 4,021,047 | 5/1977 | Mader | 273/167 H |
| 4,313,607 | 2/1982 | Thompson | 273/171 |
| 4,438,931 | 3/1984 | Motomiya | 273/80.2 |
| 4,465,221 | 8/1984 | Schmidt | 273/173 |
| 5,028,049 | 7/1991 | McKeighen | 273/167 H |
| 5,106,094 | 4/1992 | Desbiolles | 273/167 H |
| 5,232,224 | 8/1993 | Zeider | 273/167 H |
| 5,346,217 | 9/1994 | Tsuchiya | 273/167 H |

OTHER PUBLICATIONS

Yamaha article in the Jun. 1994 issue of Golf Classic printed in Tokyo, Japan, pp. 74 and 75.

*Primary Examiner*—Sebastiano Passaniti
*Attorney, Agent, or Firm*—Roberts and Quiogue

[57] ABSTRACT

A method of fabricating a metal wood club head. The head is fabricated in two half-sections, each formed by a casting technique. The two half-sections are subsequently joined by welding together facing edges of the respective half-sections along a parting line. The parting line extends through the highest point in the head crown, generally parallel to the face region and behind the hose. The placement of the parting line permits the use of simple one-piece mold cores, since there are no negative angles within the half-section elements to prevent such a core from being removed. The method is low cost, and provides a high strength club head, with the weld joint located away from club stress points.

5 Claims, 5 Drawing Sheets

FIG. 1
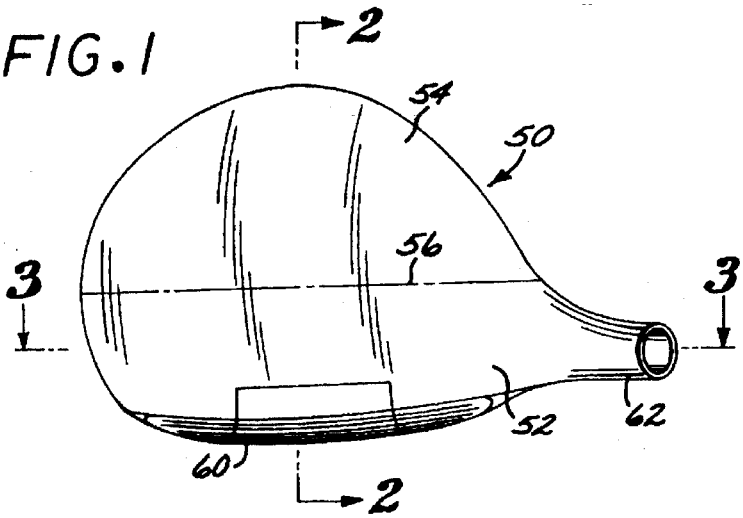
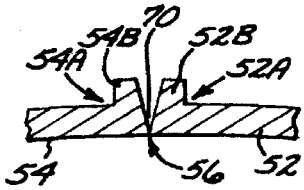
FIG. 4
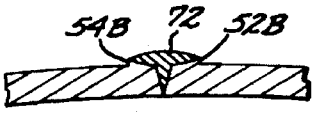
FIG. 5
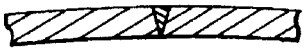
FIG. 6
FIG. 2
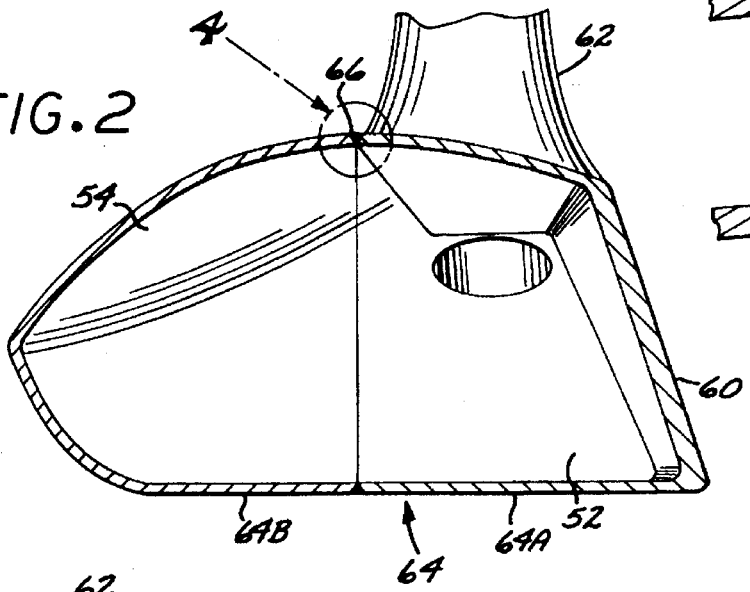
FIG. 3
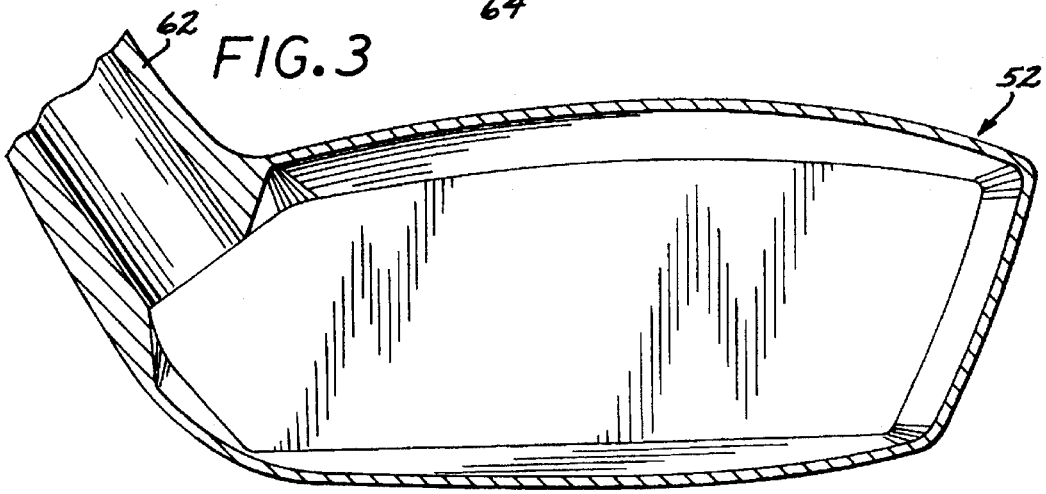

FIG. 7
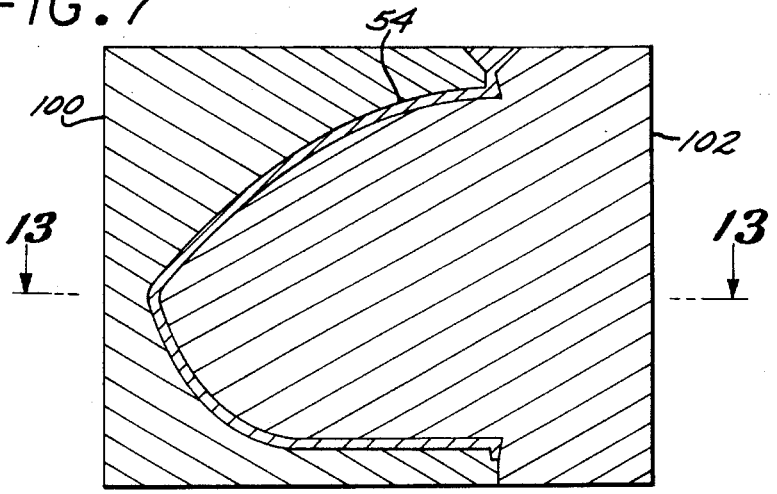
FIG. 8
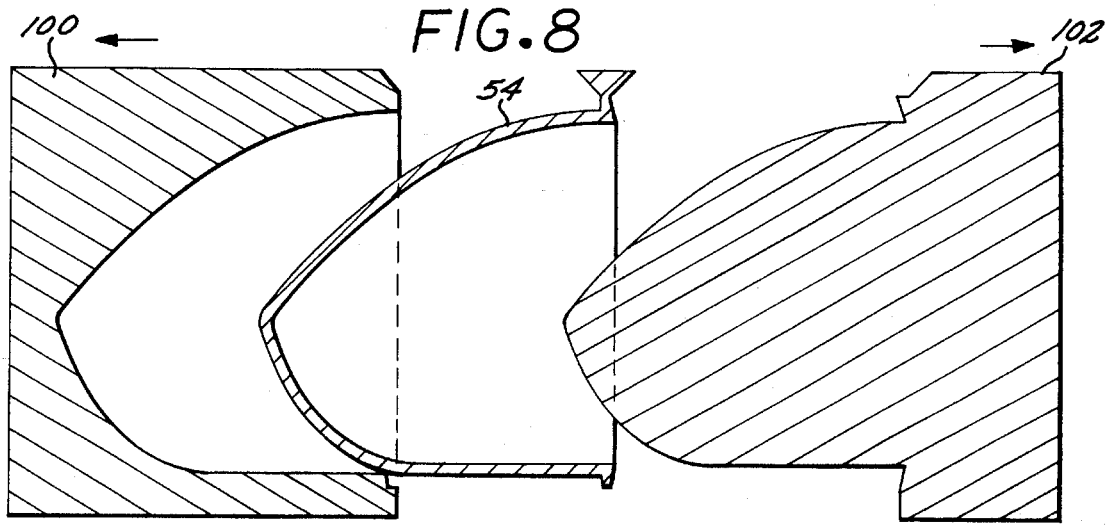
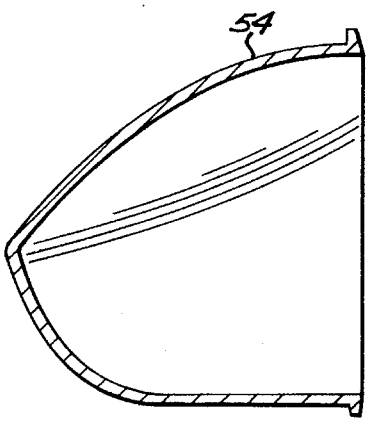
FIG. 9

GOLF WOOD CLUB HEAD FABRICATING FROM CAST HEAD SECTIONS

TECHNICAL FIELD OF THE INVENTION

This invention relates to the field of golf clubs, and more particularly to a method for fabricating metal wood club heads from castings.

BACKGROUND OF THE INVENTION

In recent years, golf wood club heads are fabricated from metal, typically hollow metal heads of a thin shell construction. Exemplary of these are the oversized drivers, fabricated from metals such as stainless steel, aluminum and titanium. Thus, "wood" club heads refer to the class of golf clubs including the driver, typically known as the number one wood, and the fairway woods, typically the number three, four, five and seven woods. The ball-impacting face of the number one wood typically is inclined from the vertical in the range of 7½ to 12 degrees, while the faces of the fairway woods have a greater inclination, e.g., 13–17 degrees for the number three wood, 20 degrees or so for the number four wood, 23 degrees for the number five wood, and 27 degrees for the number seven wood.

The fabrication of hollow metal wood heads has presented difficulties in achieving high quality parts at reasonable cost. There are several conventional fabrication techniques.

In one fabrication technique, a one piece body structure which does not include the sole plate is made by casting. Because the head body tapers from the center of the head to a smaller sole region footprint where the sole plate opening is located, a multipiece collapsible mold core must be used to cast the body structure. The different pieces of the collapsible interior mold core are then removed through the sole plate opening, and the sole plate is attached to the body structure by conventional techniques, typically welding. Multipiece collapsible mold cores are very expensive, and the set up and removal of the core is time consuming. Moreover, the core pieces can become loose due to mishandling and wear, and this can lead to out-of-tolerance club head wall thicknesses. It is quite difficult to obtain repeatable accuracy using the multipiece core molds, there are problems with the accuracy of sole-plate welding onto the head body, and therefore the yield is low.

Another fabrication technique is to fabricate the club body structure with an integral sole, to which a separate face plate is attached. A face plate opening is provided, through which interior mold core elements are removed after the body structure has been molded. The face plate is then attached to the club head body. While this technique facilitates the molding process, in that multipiece cores having fewer interior core elements may be required than are required for the technique employing interior collapsible cores removed through a sole opening, it suffers the disadvantage of imposing design constraints. The face plate opening must be designed to provide a receiving structure for the face plate, typically a recessed shoulder structure, so that the face plate can withstand the impact stress. Moreover, the face plate is typically attached by welding, and any imperfections in the quality of the welds can lead to failure or performance degradation, since the face is the only part of the wood club head that directly contacts the golf ball.

Accordingly, it would be an advance in the art to have a technique for fabricating hollow metal driver heads, without the need for expensive multipiece mold cores, and which enabled the face plate to be fabricated as an integral part of the club head body structure.

SUMMARY OF THE INVENTION

A method is disclosed for fabricating a hollow golf club head, comprising a sequence of the following steps:

casting first and second separate club head sections, the front section defining a first portion of said hollow club head including a club face region, hosel region, a front portion of a sole region and a front portion of a head crown region, the rear section defining a rear portion of the hollow club head including a rear portion of the head crown region, a rear portion of the club head and a rear portion of said sole region, said club head being defined by the front and rear club head sections; and joining the front and rear club head sections together along a seam formed by adjacent edges of the head sections to form the hollow club head.

In a preferred implementation, the two club head sections are made of a metal, and the step of joining the first and second club head sections includes welding the first and second club head sections together along the seam.

The step of casting the rear head section includes:

providing an exterior mold element defining a first cavity surface defining the exterior surface of the rear head section;

providing an interior mold core element defining a second cavity surface defining the interior surface of the rear head section;

positioning the exterior mold element and the interior mold core element in a closed mold configuration so that the first and second cavity surfaces define a mold cavity for the rear head section;

releasing molten material into the mold cavity and permitting the molten material to harden;

withdrawing the exterior mold element and the core element from the hardened material to provide the rear club head section.

The step of casting the front head section includes:

providing an interior mold core element having a cavity surface to define the interior surface of the front head section;

providing an exterior mold element having a cavity surface to define the exterior surface of the front head section;

providing a hosel mold element including a hosel pin within a hosel defining opening to define the hosel region of the club head;

assembling the interior mold core element, the exterior mold element and the hosel mold element together to define a mold cavity for the front head section;

releasing molten material into the mold cavity and permitting the molten material to harden;

removing the hosel mold element, the exterior mold element and the interior mold core element from the hardened material to provide the front head section.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1 is a top view of a metal wood golf club head constructed in accordance with the invention.

FIG. 2 is a cross-sectional view taken along line 2—2 of FIG. 1.

FIG. 3 is a cross-sectional view taken along line 3—3 of FIG. 1.

FIG. 4 is an enlargement of the area indicated in the phantom circle of FIG. 2, prior to the two halves of the club head being joined together.

FIG. 5 shows the same area as FIG. 4, after the two club head halves have been welded together.

FIG. 6 shows the same area as FIG. 5, after the weld bead has been ground away.

FIG. 7 is a cross-sectional view taken through the molds for forming the rear half-section of the golf club head of FIG. 1, after the section has been cast.

FIG. 8 shows the removal of the head half-section from the mold of FIG. 7.

FIG. 9 is a cross-sectional view of the club half-head section fabricated as shown in FIGS. 7 and 8.

DETAILED DESCRIPTION OF THE PREFERRED EMBODIMENT

Figure 10:
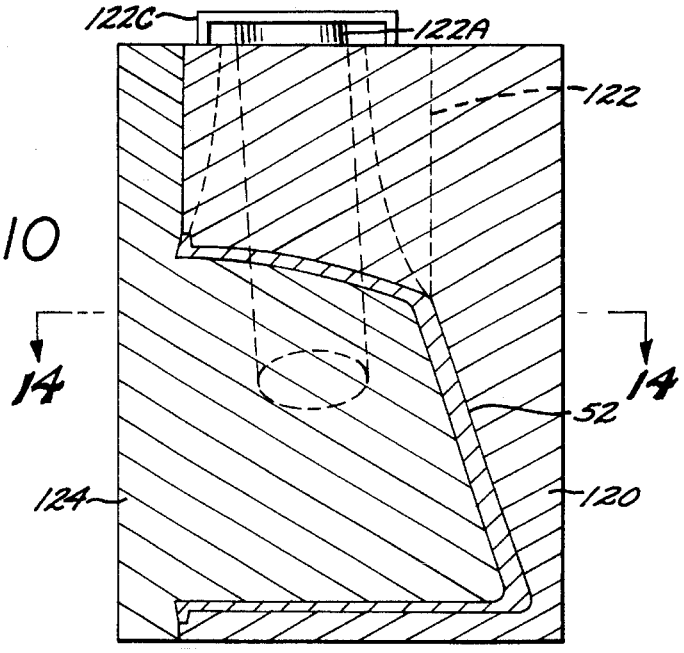
FIG. 10 is a cross-sectional view taken through the molds for forming the front half-section of the golf club of FIG. 1, taken along a line transverse to the seam at which the front and rear half-sections are joined together.

A golf metal wood driver 50 constructed in accordance with this invention is fabricated from two cast half sections 52 and 54, which are joined together along a seam 56 which extends generally parallel to the club face 60 and behind the hose 62, running along the highest part of the crown on the top of the head, along behind the hosel region, down the sides of the head and transversely along the sole region of the club head. The section element 52 is the front section of the club head, in that it defines the face region 60 and hosel 62 of the head, and as well the front portion 64A of the sole region 64. The section element 54 is the rear section of the club head, in that it defines the rear portion of the club head from the crown 66 of the club head rearwardly, and the rear portion 64B of the sole 64.

The two club head sections 52 and 54 when joined together define the hollow metal wood club head, including the face region 60, the hosel 62 and sole region 64.

The placement of the seam 56 is selected so that the interior angles formed within each head half section permit fabrication of the half section by use of a single removable simple interior mold core element. That is, the interior angles defined by the walls of the head sections 52 and 54 do not exceed ninety degrees, so that the walls of the half section do not capture the interior mold core element used in the casting process to prevent removal thereof upon completion of the mold process. As a result, the need for complex multi-piece interior mold cores, such as are required to fabricate heads having a separate sole plate, is eliminated. What is more, club heads fabricated in accordance with this process are much stronger than the cast club heads fabricated with a shell and separate face plate, since there is one piece construction at the stress zones around the face region and hosel. As a result, cracking and other like failures at the stress zones are substantially reduced.

This invention can be utilized with all types of casting methods, including die casting, investment casting, and the like. The preferred club head material used to cast the two sections 52 and 54 is a metal which can be welded along the seam 56 to join the two sections together into an integral club head. Metals useful for the purpose include stainless steel, aluminum, titanium and their alloys.

FIGS. 4–6 illustrate a preferred technique for constructing the mating edges of the two head sections 52 and 54 to facilitate the welding process. At edges 52A and 54A of the sections, ridges 52B and 54B are formed therein, so that when the two sections 52 and 54 are joined together, a channel 64 is defined. The seam is welded, with the ridges serving to facilitate holding the weld bead 72, as shown in FIG. 5. After completion of the weld operation, the ridges 52B and 54B and the bead 70 are ground off, leaving the seam flush with the exterior surface of the adjacent areas of the club head body, as shown in FIG. 6. A preferred material for the club head sections is titanium alloy TI 6-4, which can be welded in an argon atmosphere. A preferred welding technique is fuse-welding, wherein the ridges 52B and 54B are melted to fill in the weld seam, instead of melting expensive filler rods to fill the joint. The use of fuse-welding provides a significant cost advantage, since the cost of the filler rods is avoided. In a particular titanium alloy fuse-welding example, the ridges 52B and 54B can be fabricated to provide an angled surface which is at 15 to 20 degrees from the vertical, so that the channel 70 is formed by surfaces which meet to define an included angle in the range of 30 to 40 degrees. Other angles may also be suitable.

FIGS. 7–15 illustrate the method of casting the front and rear club head sections 52 and 54 in further detail. FIGS. 7–9 and 13 show the fabrication of the rear section 54. FIGS. 10–12, 14 and 15 show the fabrication of the front section 52.

Turning initially to FIGS. 7–10 and 13, the rear section 54 in this embodiment is fabricated by a casting process using an exterior mold 100 and a one piece interior mold core 102. With the two mold element in position to define the mold cavity for the head section 54, molten material, such as molten metal, is poured or injected into the mold cavity, and permitted to cool and solidify. This step in the operation is shown in FIG. 7, and in FIG. 13. After the molten material has cooled, the mold elements 100 and 102 are separated, as shown in FIG. 8, to provide the rough cast part, which upon removal of flashing results in the half section 54, as shown in FIG. 9.

Figure 11:
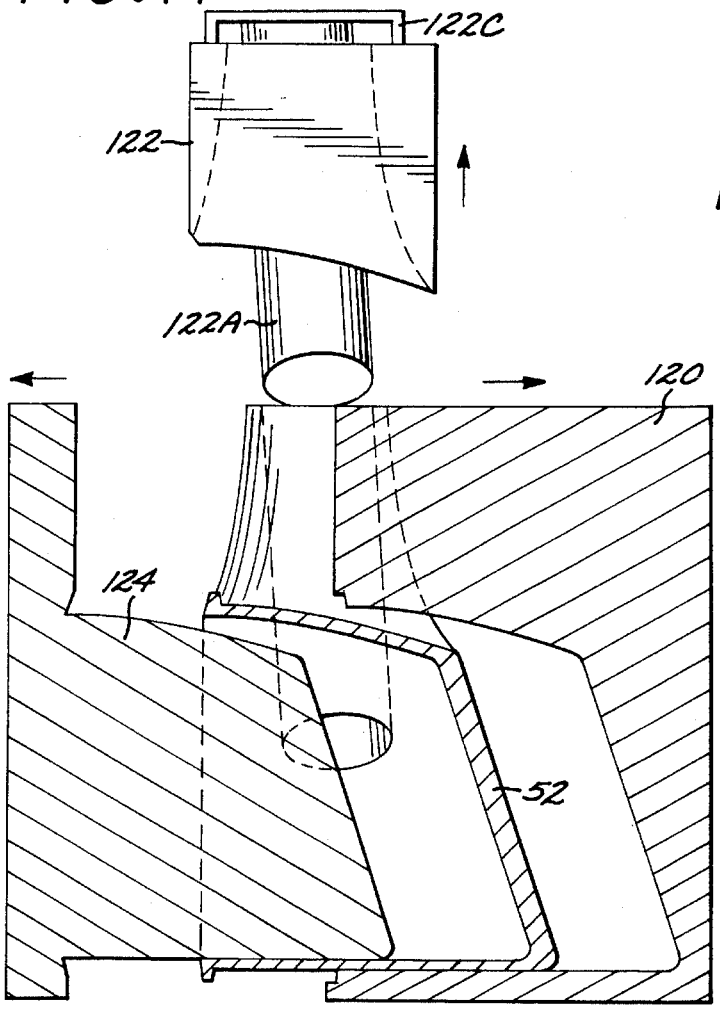
FIG. 11 shows the removal of the molds of FIG. 10 after completion of the casting process.
Figure 12:
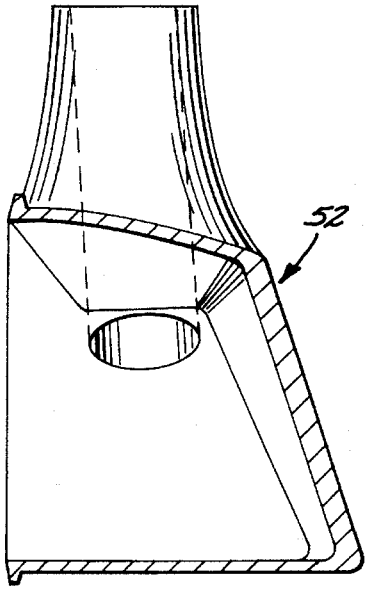
FIG. 12 shows the finished front half-section of the golf club head of FIG. 1.
Figure 13:
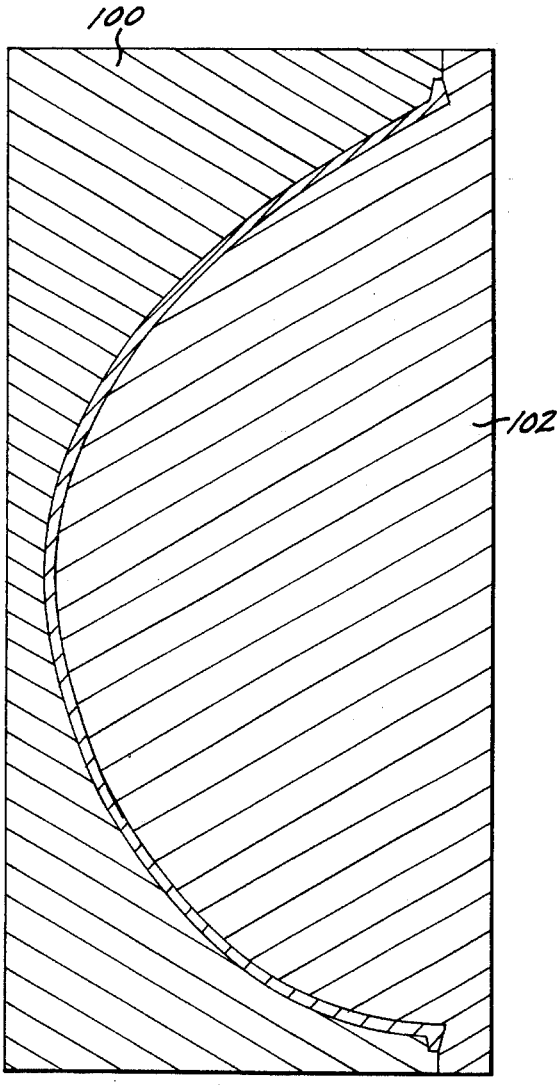
FIG. 13 is a cross-sectional view of the molds and rear half-section of FIG. 7, taken along line 13—13 of FIG. 7.
Figure 14:
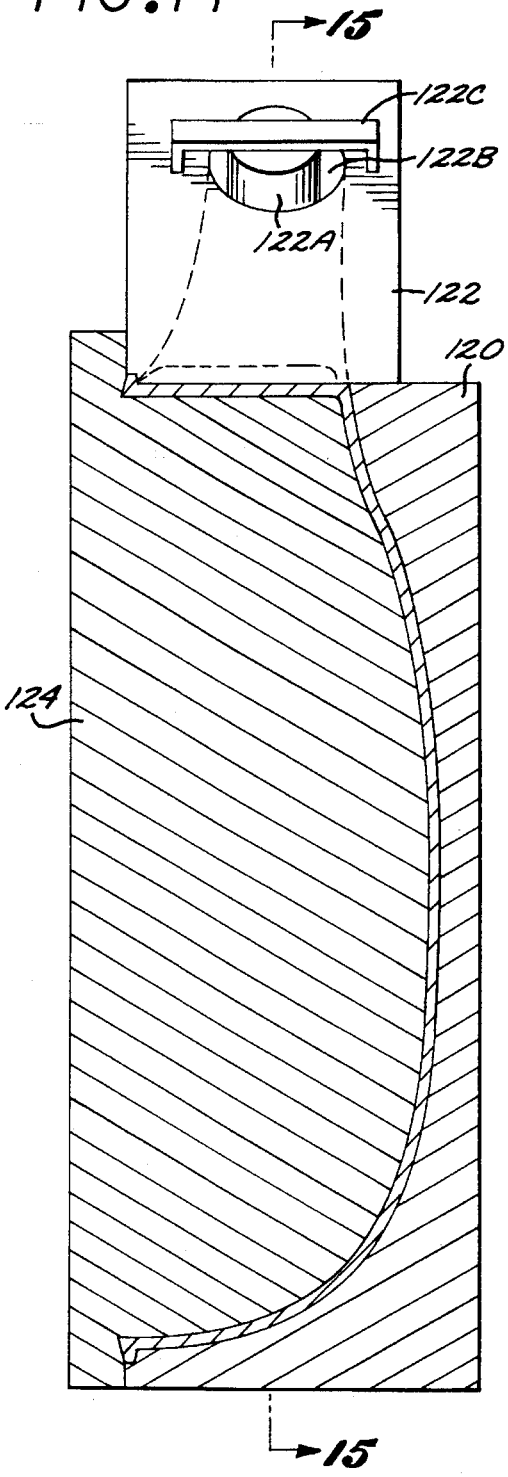
FIG. 14 is a cross-sectional view of the molds and front half-section of FIG. 10, taken along line 14—14 of FIG. 10.
Figure 15:
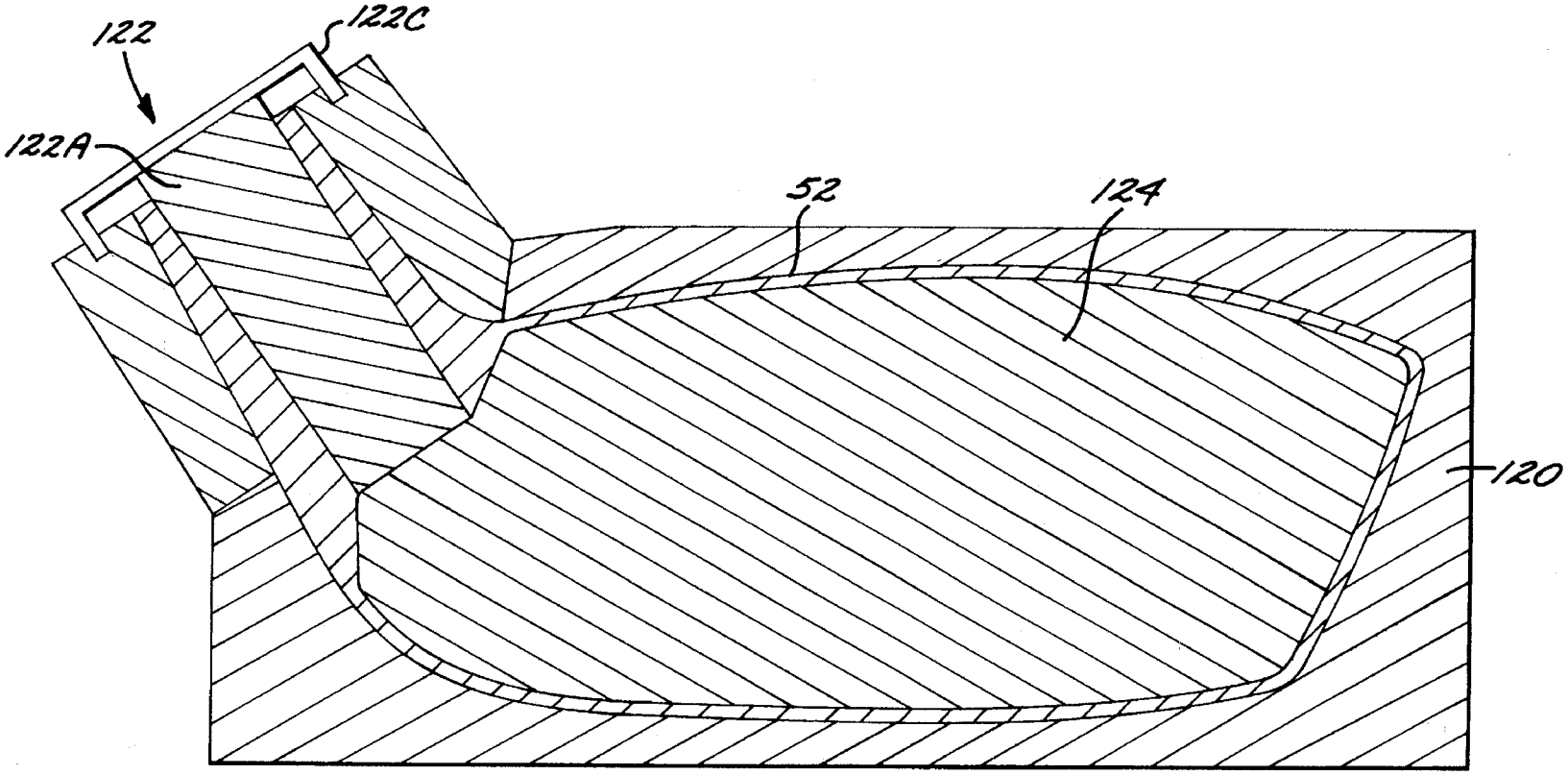
FIG. 15 is a cross-sectional view taken along line 15—15 of FIG. 14.

The fabrication of the front head section 52 is illustrated in FIGS. 10–12, 14 and 15. The front section 52, in this exemplary embodiment, is fabricated in a casting process using three mold elements 120, 122 and 124 to define the cavity for the section 52. The exterior mold element 120 fits together with the hosel mold element 122 and the interior mold core 124 to define the cavity for head section 52. The hosel mold element 122 includes a pin 122A suspended within a cylindrical opening 122B (FIG. 14) to define the opening for receiving the club shaft (not shown). FIGS. 10, 14 and 15 show the mold elements in position to define the mold cavity. Molten material is then poured or injected into the mold cavity, and permitted to cool and harden. There-after, the three mold elements 120, 122 and 124 are separated, as shown in FIG. 11, to provide the club head front section 52 (FIG. 12). The one piece, removable configuration of the interior mold core 124 is clearly shown.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A golf metal wood club head fabricated from cast head sections, comprising:

front and rear separate club head sections, wherein each of said front and rear head sections is a product of casting molten material in a mold;

said front section defining a first portion of said hollow club head including an entire club face region, an entire hosel region having a hosel opening, a front portion of a sole region and a front portion of a head crown region said rear section defining a rear portion of said hollow club head including a rear portion of said head crown region, a rear portion of said club head and a rear portion of said sole region, wherein said rear section does not define any part of the hosel region;

said club head being defined by said front and rear club head sections;

said front and rear club head sections joined together along a seam formed by adjacent edges of said head sections, and wherein said seam does not intersect the hosel opening.

2. The club head of claim 1 wherein said front and rear club head sections are welded together along said seam.

3. The club head of claim 1 wherein said seam extends along a highest crown point of the club head, along heel and toe regions of the club head and along the sole region of the club head.

4. The club head of claim 1 wherein said front and rear club head sections are fabricated from metal material, said material selected from the group consisting of stainless steel, aluminum, titanium and alloys thereof.

5. The club head of claim 1 wherein said front section is a unitary one piece structure, providing one piece construction at stress areas around the face region and hosel region, thereby reducing a risk of cracking failures at the stress areas resulting from impact forces during play of the club head.

* * * * *